United States Patent [19]

Miskin

[11] Patent Number: 4,466,638

[45] Date of Patent: Aug. 21, 1984

[54] DIRECTORY HOLDERS

[76] Inventor: Renold A. Miskin, 752 Ashton Ave. Salt Lake City, Utah 84115

[21] Appl. No.: 309,603

[22] Filed: Oct. 8, 1981

[51] Int. Cl.[3] ..... A47B 23/04; B42D 9/00; B42D 11/00

[52] U.S. Cl. ..... 281/33; 281/29; 281/46; 248/451; 248/447; 248/453; 402/4; 402/77

[58] Field of Search ..... 248/441 R, 445, 447, 248/451, 454, 455, 453; 281/29, 33, 34, 45, 46, 48, 49, 18, 21 R; 402/4, 70, 71, 72, 73, 74, 75, 76, 77, 78

[56] References Cited

U.S. PATENT DOCUMENTS

| | | | |
|---|---|---|---|
| 1,004,802 | 10/1911 | Martin | 281/46 |
| 1,197,610 | 9/1916 | Darling | 291/33 |
| 1,564,594 | 12/1925 | Leh | 281/33 X |
| 1,890,840 | 12/1932 | Brewer | 281/45 |
| 1,911,799 | 5/1933 | Buchan | 248/447 |
| 1,984,711 | 12/1934 | Van Alstyne | 281/33 X |
| 2,832,348 | 4/1958 | Demarest, Jr. | 402/77 X |
| 2,834,148 | 5/1958 | Walter et al. | 248/447 |
| 3,617,074 | 11/1971 | Rigolini | 291/49 X |
| 3,635,351 | 1/1972 | Homs | 248/447 X |
| 3,860,212 | 1/1975 | Nauman | 281/45 X |
| 4,152,013 | 5/1979 | Azzato | 402/76 X |

FOREIGN PATENT DOCUMENTS

| | | | |
|---|---|---|---|
| 695551 | 12/1930 | France | 281/49 |
| 12451 | of 1910 | United Kingdom | 281/49 |
| 17579 | of 1910 | United Kingdom | 281/49 |
| 518389 | 2/1940 | United Kingdom | 281/49 |

*Primary Examiner*—Paul A. Bell

*Attorney, Agent, or Firm*—Terry M. Crellin

[57] ABSTRACT

A directory holder is disclosed. The holder includes a bed with a cover hinged to the bed. The bed and cover each have flanges which cooperate to form a case for the directory. The cover and bed are hinged together with plural pivoting clips and, in addition, a security bar is provided to prevent unwanted removal of the directory from the bed and cover.

6 Claims, 13 Drawing Figures

Fig. 5
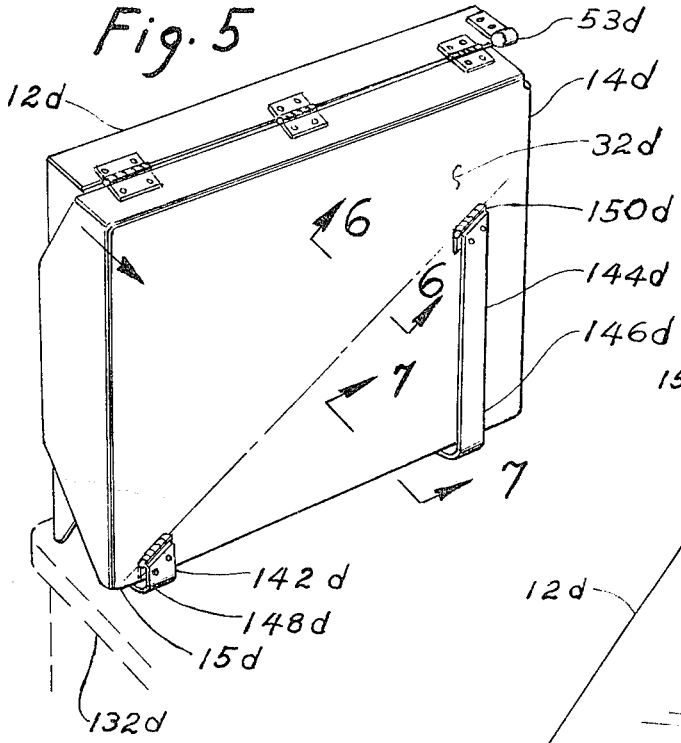
Fig. 6
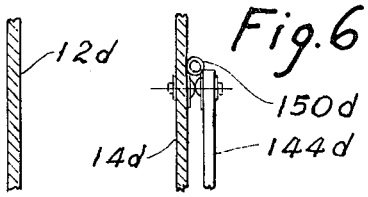
Fig. 7
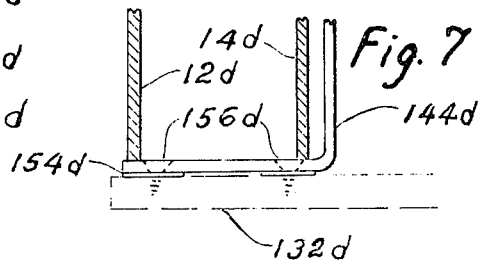
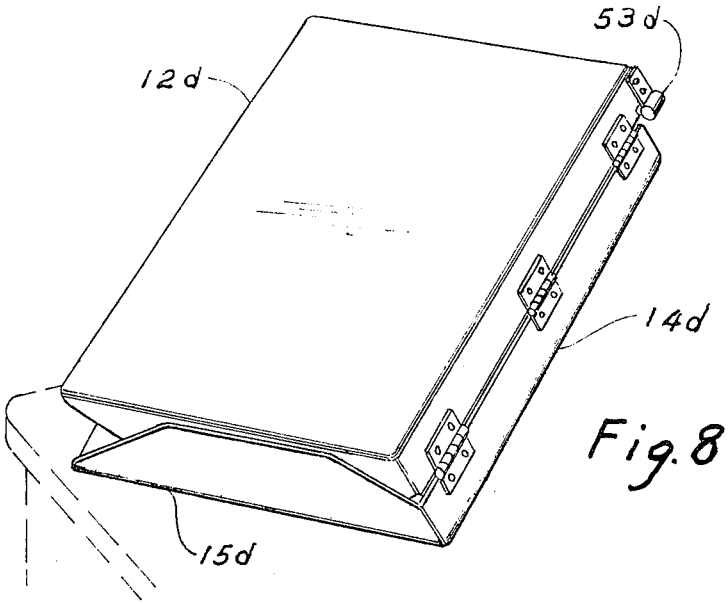
Fig. 8
Fig. 10
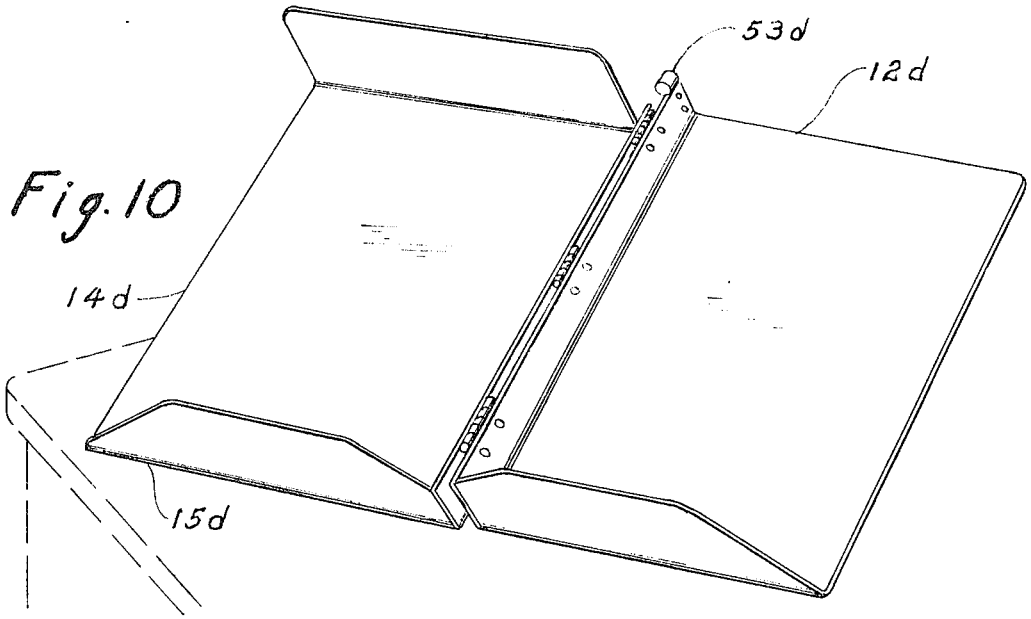

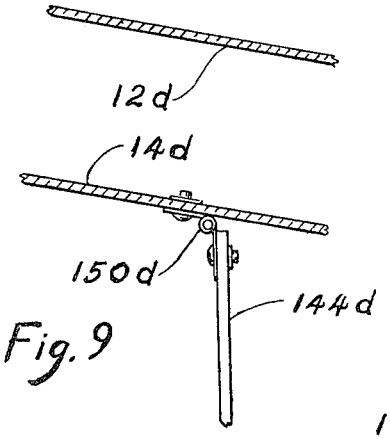
Fig. 9
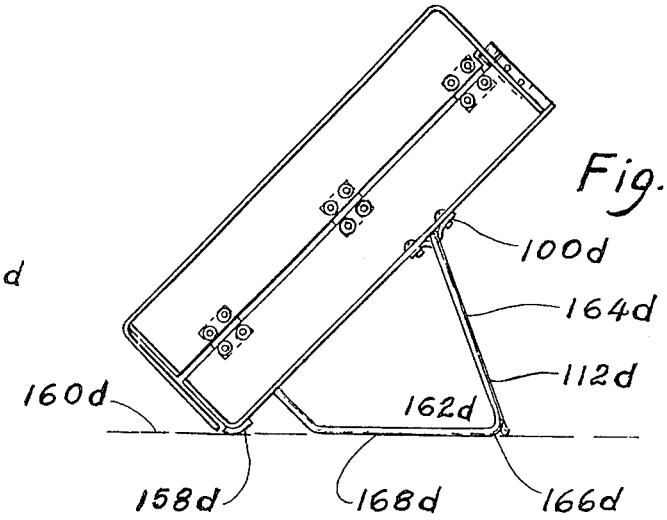
Fig. 11
Fig. 12
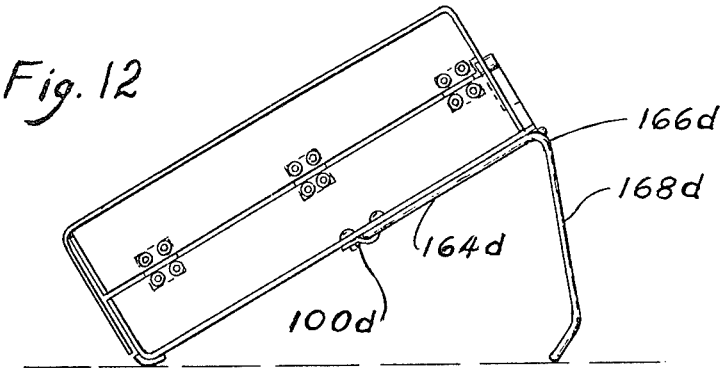
Fig. 13
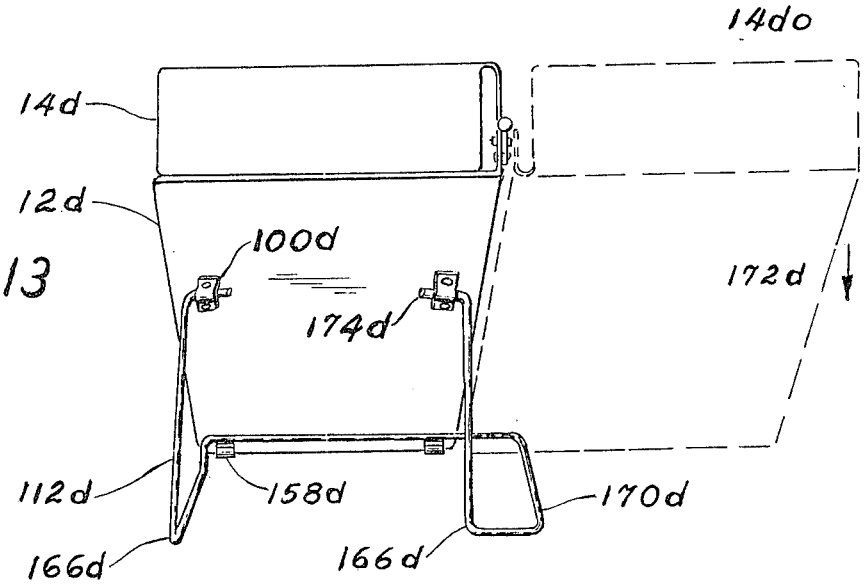

DIRECTORY HOLDERS

RELATED APPLICATION

The present application is related to U.S. application Ser. No. 159,960, filed June 16, 1980, which in turn was a continuation of U.S. application Ser. No. 892,997, filed Apr. 3, 1978. Both application Ser. Nos. 159,960 and 892,997 are now abandoned.

FIELD OF THE INVENTION

This invention relates generally to book holders and more particularly to telephone directory holders that are quick and convenient to use in searching for telephone numbers and other information present in such directories. The directory holders of the present invention preserve the directories to keep them in good appearance as with the directory holders of my copending application mentioned, and have additional improvements.

Because of the very usefulness of telephone directories and the demand on them by most people, these directories, without my copending or my present invention, generally become badly abused and unsightly. Not only that, but they are many times in inconvenient places in businesses and homes and their location must often be searched out.

BACKGROUND OF THE INVENTION

In the prior art, book holders have been patented that were primarily designed for handicapped and bed-ridden people and for people doing much reading such as students. Some of these inventions utilized devices such as rods and clamps to hold the book open and in a comfortable position, but these bookholders are not convenient nor efficient for holding telephone directories, especially for short intermittent uses or for searching.

There are several patents of telephone directory holders intended for use in phone booths in which cases means are described for holding the directory in a hanging position below a shelf and for swinging it to a position above the shelf where it can be opened. These directory holders provide some security for the directory and make is possible to locate a number with time and patience. However, considering all the circumstances under which telephone directories are used, no satisfactory means has been provided, previous to the invention of my copending application, whereby telephone directories could be kept in a ready-to-use position for quick and easy searching in a convenient location of ones choosing in a position of comfort to the user and of pleasant appearance, and which could be cheaply manufactured for use in homes and businesses.

OBJECTS OF THE INVENTION

It is an object of my invention to provide an improved basic directory holding device, usually referred to as the basic directory holder that is useful as a portable directory holder, and that can be mounted in various ways and locations for convenient use as desired as mentioned in my copending application referred to.

It is another object of my invention to provide bottom flanges on the bed and the cover with more taper toward both sides to provide easier access for the user's fingers to touch the directory in the directory holder.

It is another object of my invention to provide security bar means to replace the security loop means claimed in the affore referred to copending application.

It is another object of my invention to provide a directory holder for use on a desk or the like which occupies a minimum of space, which stays in its location and which is automatically positioned at a comfortable slope and at a convenient angle when opened comprising the basic directory holder of my invention, mounting brackets, and means for attaching the mounting brackets firmly to the desk.

It is another object of my invention to provide a directory holder for use on a desk or the like, movable as desired, and easily changeable to a portable directory holder and vise versa, comprising the basic directory holder of my invention, bearing loops attached to the underside of the holder bed, a slope-holding brace with the ends thereof in the bearing loops for holding the basic directory holder in a choice of two slopes, and footings firmly attached underneath to the lower edge of the bed for stability and to resist sliding.

SUMMARY OF THE INVENTION

Development of the present invention has provided a basic directory holder with improved bottom support flanges for easier handling of the directories, especially thick ones, a security bar that is cheaper to manufacture than the metal security loop of my referenced copending application, a permanently located directory holder that is kept at the very edge of a desk or the like out of the way with open side down when not in use and automatically positioned for comfortable use when opened, and a movable directory holder that rests on a desk on the like with a slope-holdling brace that extends past the hinge brackets for stability and holds the directory holder at a choice of two slopes, and which brace can easily be removed to provide a directory holder that can be used as a portable directory holder.

The basic directory holder is utilized in each adaptation.

BRIEF DESCRIPTION OF THE DRAWINGS

FIG. 2 is a lower front pictorial view of the basic directory holder shown opened. The upper and lower pivoting clips are not shown in this view for the sake of simplicity. They are, however, clearly illustrated in my copending application referred to.

FIG. 5 is a pictorial view of the permanently located desk model directory holder showing it hingeably mounted open side down on a desk.

FIG. 6 is a partial sectional view taken along the lines 6—6 of FIG. 5.

FIG. 7 is a partial sectional view taken along lines 7—7 of FIG. 5.

FIG. 8 is a pictorial view of the directory holder of FIG. 5 having been pivoted down to the desk ready to be opened.

FIG. 9 is a partial sectional view showing the parts of FIG. 6 after having been pivoted as shown in FIG. 8.

FIG. 10 is a pictorial view of the directory holder of FIGS. 5 and 8 after being opened.

FIG. 11 is a right side view of the movable desk model directory holder with the slope-holding brace in place holding the directory holder in the steeper position.

FIG. 12 is a right side view of the directory holder of FIG. 11 with the slope-holding brace holding the directory holder in a more gradual slope on the desk.

FIG. 13 is a close-up rear pictorial view showing the directory holder in the steeper position of FIG. 11.

DETAILED DESCRIPTION OF THE DRAWINGS

Figure 1:
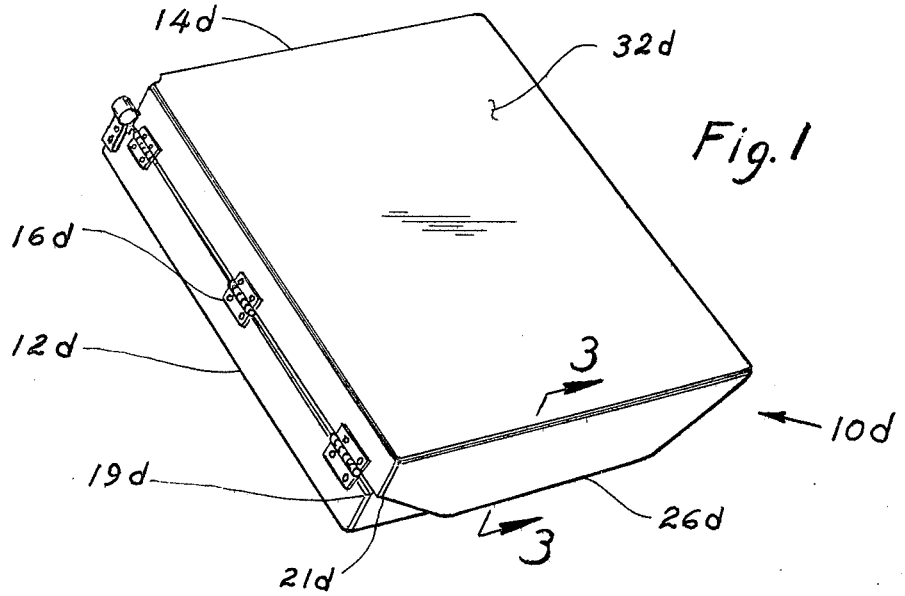
FIG. 1 is a pictorial view of the basic directory holder of my invention shown in closed position, and is taken from the lower left side.

Referring to the drawings for further disclosure and clarification, for the sake of uniformity, the same designation numerals are used in the present application as in the referenced copending application where names of parts and items correspond but the small letter d is added to all designation numerals in the present application to differentiate between the two applications.

Therefore the numeral 10*d* designates the basic directory holder of my present invention and as such is the portable model. The numeral 11*d* designates the case of my present invention which represents the cover hingeably attached to the bed but does not include the upper and lower clips nor the security bar and therefore is not a directory holder as such.

The description of my basic directory holder invention as given on page 5 and the first paragraph of page 6 of the referenced copending application applies equally well to the basic directory holder of my present invention.

Figure 2:
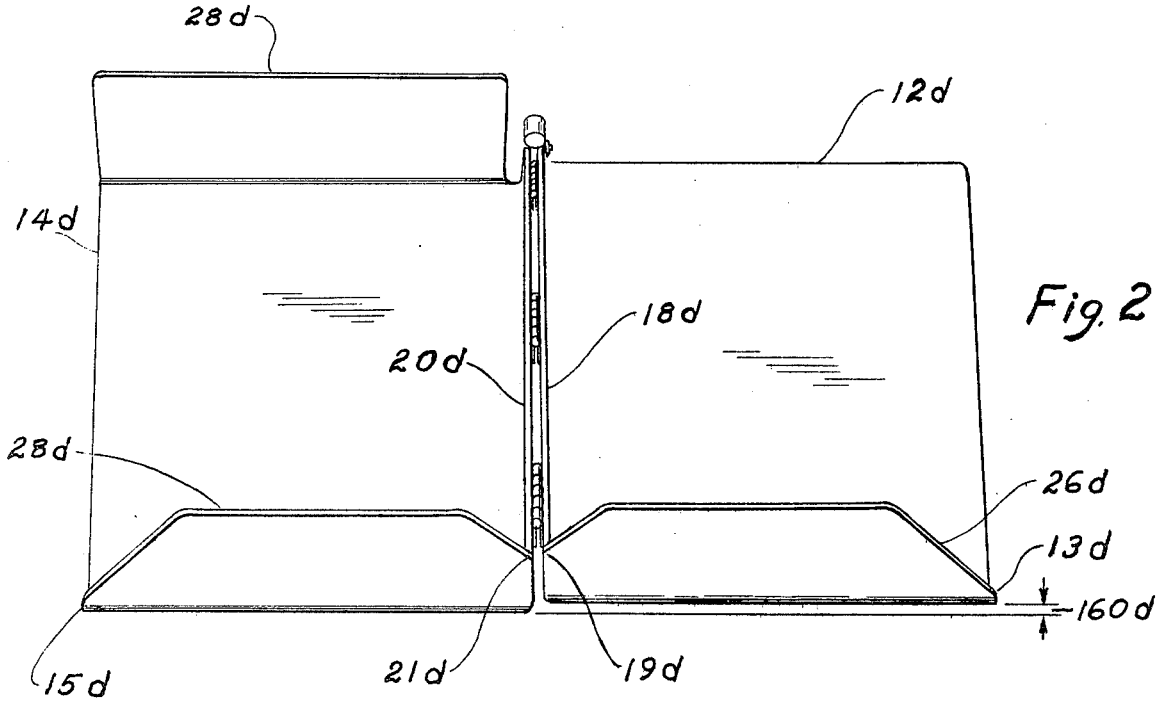

However, the outside ends of the holder bed bottom flange 26*d* and the cover bottom flange 28*d* and tapered all the way to the outside bottom lower corners as indicated at 13*d* and 15*d* of FIG. 2.

The inside ends of said flanges, it is noted, are tapered down, as seen in FIG. 2, to a height that meets the bed hinge flange 18*d* and the cover hinge flange 20*d* as seen at 19*d* and 21*d* of FIGS. 1 and 2. These tapers allow the user to better handle and touch the directory in searching for information.

As a result of the bed and cover bottom flanges being so tapered at both sides, the flanges can be made wider along the midsection for supporting thicker directories and still allow access to the directory for the user to touch the directory and turn the pages as convenient.

Figure 3:
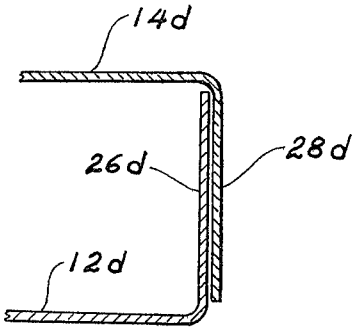
FIG. 3 is a partial cross sectional view taken along lines 3—3 of FIG 1.

The cross sectional view FIG. 3, showing the bottom flanges 26*d* and 28*d* overlapping at lines 3—3 of FIG. 1 illustrates the fact that the widest portion is intermediate of the flange.

It will also be noted that the cover hinge flange 20*d* has been extended to meet the cover bottom flange 28*d* at the corner 21*d* so that these two flanges can also either be cemented together or molded integrally for greater strength. It will also be noted that bed hinge flange 18*d* and bed bottom flange 26*d* meet at the inside corner 19*d* allowing them to be cemented together or molded integrally for greater strength. This strength is especially important for the bottom flanges when they are in open position because directory users are then inclined to put their weight on them.

Figure 4:
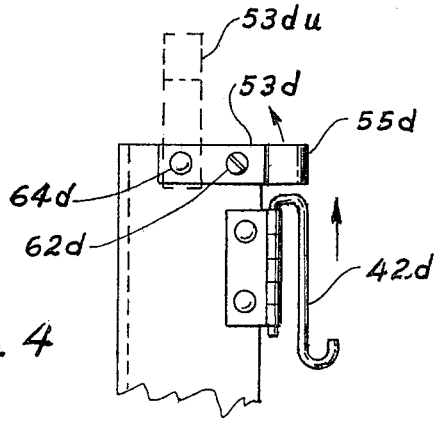
FIG. 4 is a partial view taken along the lines 4—4 of FIG. 2 with the upper clip added.

The security bar improvement is clearly illustrated in FIG. 4 which shows the security bar 53*d* located in the place of the security loop of the referenced copending application. The portion 55*d* is of cylindrical shape to prevent the position pin from moving upward. By removing lock screw 62*d* the security bar can be pivoted about rivet 64*d* to unlocked position 53*du*. The position pin 42*d*, also referred to as the upper clip, can then be moved upward and out so that the directory can be taken out.

The permanently mountable directory holder of my present invention for use on a desk or "the like" is clearly illustrated in FIGS. 5, 6, 7, 8, 9 and 10. FIG. 5 shows it in non-use position mounted near the edge of desk 132*d* with the open side of the case down. Thus it is clear to see that it occupies a minimum of space and out of a desk worker's work area when placed in its non-use position. Because this directory holder is so mounted near the edge of the desk with the directory on edge, it is usually referred to as the edge model.

This directory holder is hingeably mounted to the vertical portions 142*d* and 144*d* of L shaped brackets 146*d* and 148*d* with the hinges 150*d* attached to the brackets at a fairly steep angle and in line with each other as seen in FIG. 5. Thus when the basic directory holder is tipped in the direction indicated by the arrow, it pivots about the hinge line and comes to rest on desk 152*d* shown in FIG. 8.

Because the tall mounting bracket 146*d* supports the upper end of the basic directory holder at a much higher elevation than the short mounting bracket, 148*d* supports the lower end and the basic directory holder rotates to a desirable slope on the desk for searching in the directory.

It is also noted that the hinge line passes through the lower corner 15*d* so that this corner remains essentially in the same location on the desk after the directory holder is pivoted to the using position shown in FIG. 8 as it was in the non-use position of FIG. 5. This action allows corner 15*d* to rest very near the surface of the desk when the directory is in the using position and gives an impression of uniformity as if the directory holder were totally resting on the desk all along the bottom flanges whether open or closed.

FIG. 6 illustrates in clear detail how the basic directory holder is hingeably mounted with hinges 150*d* to the mounting brackets 146*d* and 148*d*. The hinges are so attached between the panel 32*d* of the cover 14*d* and the vertical portions 142*d* and 144*d* of the mounting brackets that space is allowed between the hinge wings for the mounting rivet heads.

It is to be noted from FIGS. 5 and 7 that the horizontal portions of the mounting brackets extend beneath the basic directory holder towards the left edge of the desk to give direct support to the weight of the directory holder with the directory. This also has the advantage of giving a better and neater appearance by keeping the horizontal portions out of sight and out of the work area.

Attaching the horizontal portions firmly to the desk is preferably done with pressure sensitive tape 152*d* that is sticky on both sides as illustrated in FIG. 7 showing horizontal portion 152*d* of tall mounting bracket 146*d* and double sticky tape 154*d* to avoid maring the desk surface.

In cases where it is desired to mount the edge model directory holder to a work bench or the like, using screws as shown at 156*d* may be preferred.

FIG. 9 is given to help one understand the movement and position of the hinges 150*d* and the directory holder when the directory holder is tipped and rotated to the using position. FIG. 7 is taken along the same lines as 6—6 in relation to the tall mounting bracket and shows the amount that the basic directory holder has rotated about the hinge line to the using position shown in FIG. 8.

FIG. 10 shows the same directory holder of FIGS. 5 and 8 in the using position and opened. Note that the cover 14*d* is in the same position and location in both views being held so by the mounting brackets not visible. Note that the bottom edge of holder bed 12*d* rests entirely on the desk for support and that the bottom portion of the cover 14*d* nearest the hinge flange also rests on the desk and that the corner 15*d* appears to rest on the desk and may even touch the desk even through it is supported by the short mounting bracket.

The upper and lower clips are not shown in FIG. 10 for the sake of simplicity. Neither is the directory location in the director holder indicated for the same reason. These are very clearly shown in the drawings of my referenced copending application.

At this point it should be pointed out that when the edge model is mounted on the left edge of the desk as shown in FIG. 5, the cover, not the bed, is hingeably attached to the mounting brackets and that when the directory holder is in the using position as shown in FIG. 8 the bed, not the cover, must be turned from left to right to open the directory holder.

Therefore it is hereby noted that the basic directory holder is just as easily mounted on the desk near the right hand edge by using mounting brackets made opposite to those shown so that the basic directory holder tips, rotates and opens from right to left toward the middle of the desk and the cover is turned to open the directory holder as a book is opened to the first page.

The adaptation of my directory holder of my present invention, shown in FIGS. 11, 12 and 13, referred to as the desk model, has improvements over the desk model described in the last paragraph of page 10 and the first two paragraphs of page 11, and shown in FIGS. 14, 15 and 16, of my referenced copending application that make it cheaper to manufacture and sell and more stable so that it doesn't tip when the directory load is on the cover in open position.

As seen in FIGS. 11, 12 and 13 of the present application, footings 158*d*, attached to the bottom edge of the holder bed, rest on the desk surface. These footings accomplish two purposes: (1) to bolster the holder bed up equal to the amount shown at 160*d* of FIG. 2 which view is essentially the same as a front view of FIG. 11 would be with the directory holder open, and (2) to provide means for preventing sliding of the directory holder when in use, the footings being preferably made of rubber. The bolstering means provide stability in preventing a teetering effect otherwise present when the directory holder is open and the directory is turned from the cover to the bed.

Referring again to FIGS. 11, 12 and 13, the slope-holding brace 112*d* usually referred to as the slope brace, pivots in bearing loops 100*d* which are so located a little higher than midway on the basic directory holder for good stability positions the basic directory holder in a fairly steep slope when pivoted to the downward position shown in FIG. 11 and in a more gradual slope when pivoted forward and upward. The location of the bearing loops, the amount of the acute angle at 162*d*, the length of the straight portions 164*d* from the bearing loops to the bends 166*d*, and the length of the generally horizontal portion 168*d* are all properly interrelated in order to hold the basic directory holder in the choice of the two slopes shown.

It will be noted in FIG. 12 that the length of the straight portion 164*d* is essentially the same as the distance from the bearing loops to the upper end of the basic directory holder in order to give it good support in the position of FIG. 12 but at the same time use only a minimum of space on the desk by not extending beyond the upper end and that this length is also right for holding the basic directory holder in the preferred steeper slope.

It will also be noted that the length of portion 168*d* is right for holding the basic directory holder in the preferred gradual slope of FIG. 12 but does not interfer with the bed bottom surface when in the position shown in FIG. 11. The preferred angle of slope of the steeper position is approximately 45′ and the preferred angle of slope of the more gradual position is approximately 30°.

In the rear pictorial view of the desk model directory holder of FIG. 13 the extension 170*d* is shown extending to the side past the hinge brackets to provide stability that is especially needed when the directory load is entirely in the cover when open. An outline of the open cover is shown in broken lines and the otherwise unsupported load is represented weighing down from the upper outer corner by arrow at 172*d* and the load is then supported by the extension so that tipping in the direction of the arrow does not occur.

In FIG. 13 it is also clearly illustrated that the ends 174*d* of the slope brace are easily placed in the bearing loops 100*d* and just as easily taken out simply by utilizing the resiliency of the metal of which they are made which is usually steel simply by flexing the ends apart then letting them resume their normal position to remain in place or disassembled. Without the slope brace, the directory holder is essentially a basic directory holder except that it has the bearing loops and the footings attached and as such serves very well as a portable directory holder.

This convertability of the desk model directory holder enables a user to convert his desk model to essentially a portable model, take it with him in his car while driving then quickly convert it back to a desk model upon returning to his office. This capability increases its salesability.

Various changes in the dimensions, form, configuration and adaptations of my invention shown and described herein may be made without departing from the spirit of the invention, the scope of which is set forth in the appended claims.

What I claim as new and novel and desire to protect by Letter Patent is:

1. A directory holding device which is adapted to contain, preserve, support and secure a directory such as a telephone directory, said directory holding device comprising:

(a) a bed means adapted to receive a directory, said bed means having a top end, two opposite side ends and a bottom end, with the top side and bottom ends being adjacent the top, two sides and bottom, respectively, of a directory when the directory is received in said bed means;

(b) cover means having a top end, two opposite side ends and a bottom end;

(c) hinge means adapted for hingedly attaching said cover means, along one side end thereof, to a mutually respective side end of said bed means, so that the cover means can be moved from a closed position, in which it substantially overlies said bed means with the top, side and bottom ends thereof corresponding to and overlying the top, side and bottom ends, respectively, of said bed means, to an open position in which said cover means lies substantially adjacent to said bed means, whereby said cover means is adapted to cover the directory when said cover means is in the closed position overlying said bed means and to receive any portion of the directory when said cover means is in the open position lying adjacent to said bed means;

(d) flange support means at the respective bottom ends of said bed means and said cover means for supporting the pages of a directory when any portion of said directory is received in said bed means and said cover means, each of said flange support means being attached along their mutually respective longitudinal base edges to respective bottom ends of the respective bed means and cover means so that the respective flange support means extend in planes which are generally perpendicular with the bottom ends of the bed means and cover means; and (e) means for holding the device in an upstanding position extending upwardly from a flat support base, such as a desk, with one of the longitudinal side edges of said device being adjacent to said support base, said means for holding the device further being adapted to allow the device to tilt along a tilt axis which extends upwardly to an acute angle to said support base, whereby when said device is moved to its tilted position, the bottom end of said bed means lies substantially adjacent to said support base and the broad, flat face of said bed means tilts upwardly from said support base in a plane lying substantially along said tilt axis.

2. The device of claim 1, wherein said flange support means on said bed means and said cover means overlap when the cover means is in its closed position, and each of the respective flange support means has a width which is substantially the same dimension as the depth of the directory holding device when said cover means is in its closed position.

3. The device of claim 2, wherein said bed means and cover means are hingedly connected at side flanges which extend from mutually respective side edges of said bed means and cover means, with said side flanges having a width of about one-half the width of said flange support means.

4. The device of claim 3 in which the ends of said flange support means are integrally attached to mutually respective ends of respective side flanges on said bed means and said cover means.

5. The device of claim 13 wherein the means for holding the device in an upstanding postion comprises bracket means extending upwardly from said support base, said bracket means having hinges which pivotally connect the bed means of said device to the bracket means for pivotal movement of the bed means about said tilt axis.

6. A directory holding device which is adapted to contain, preserve, support and secure a directory such as a telephone directory, said directory holding device comprising:

(a) a bed means adapted to receive a directory, said bed means having a top end, two opposite side ends and a bottom end, with the top side and bottom ends being adjacent the top, two sides and bottom, respectively, of a directory when the directory is received in said bed means;

(b) cover means having a top end, two opposite side ends and a bottom end;

(c) hinge means adapted for hingedly attacking said cover means, along one side end thereof, to a mutually respective side end of said bed means, so that the cover means can be moved from a closed position, in which it substantially overlies said bed means with the top, side and bottom ends thereof corresponding to and overlying the top, side and bottom ends, respectively, of said bed means, to an open position in which said cover means lies substantially adjacent to said bed means, whereby said cover means is adapted to cover the directory when said cover means is in the closed position overlying said bed means and to receive any portion of the directory when said cover means is in the open position lying adjacent to said bed means;

(d) flange support means at the respective bottom ends of said bed means and said cover means for supporting the pages of a directory when any portion of said directory is received in said bed means and said cover means, each of said flange support means being attached along their mutually respective longitudinal base edges to respective bottom ends of the respective bed means and cover means so that the respective flange support means extend in planes which are generally perpendicular with the bottom ends of the bed means and cover means; and (e) means for resting said device on a flat support base, such as a desk, such that the bottom end of said bed means lies substantially adjacent to said base and the broad, flat face of said bed means slopes upwardly at an acute angle from said support base, said means for resting said device on the flat support base comprising brace means pivotally attached to the outer, broad, flat face of said bed means, said brace means comprising an elongate rod which is bent to form a generally block U-shape, with the extending legs of the U-shaped brace means being bent back upon themselves at a point about midway the length of the respective legs to that the bent back portions form acute angles and a general V-shape with the remaining portions of the respective legs of the U-shaped brace means, said bent back portions also being positioned in a common plane, said free ends of the legs of the U-shaped brace means being pivotally and removably attached to the outer, broad, flat face of said bed means, whereby the U-shaped brace member can be pivoted between (1) a first position in which the base of the U-shaped member is adjacent to the bottom end of said bed means, and said remaining portions of the legs of said U-shaped member contact and lie on said flat support base, and (2) a second position in which the bent back portions of the legs of said U-shaped member contact and lie on the outer, broad, flat face of said bed means and the base of the U-shaped member contacts and lies on said flat support base.

* * * * *